United States Patent [19]

Leclerc et al.

[11] Patent Number: 5,015,806

[45] Date of Patent: May 14, 1991

[54] ELECTRICAL SWITCHING DEVICE

[75] Inventors: Guy Leclerc, Candiac; Serge Bernier, Saint-Bruno; Philippe Lalande; Nevenka Prijic, both of Montréal, all of Canada

[73] Assignee: Honeywell Amplitrol, Inc., Candiac, Canada

[21] Appl. No.: 495,130

[22] Filed: Mar. 19, 1990

[51] Int. Cl.[5] ..... H01H 3/02

[52] U.S. Cl. ..... 200/52 R; 200/61.85; 200/505

[58] Field of Search ..... 200/52 R, 61.54, 61.93, 200/81 H, DIG. 2, 505, 520

[56] References Cited

U.S. PATENT DOCUMENTS

| | | | |
|---|---|---|---|
| 1,496,864 | 6/1924 | Robinson et al. | 340/574 |
| 1,911,444 | 5/1933 | Fator | 200/505 |
| 2,010,233 | 8/1935 | Hopkins et al. | 340/286.04 |
| 2,054,792 | 9/1936 | Derby et al. | 200/219 |
| 3,934,101 | 1/1976 | Jones | 200/61.54 X |
| 4,262,180 | 4/1981 | Walter | 200/43.07 |
| 4,300,129 | 11/1981 | Cataldo | 340/539 |
| 4,671,289 | 6/1987 | Gainsley et al. | 200/505 X |
| 4,737,751 | 4/1988 | Risk | 335/207 |

*Primary Examiner*—J. R. Scott

*Attorney, Agent, or Firm*—Foley & Lardner

[57] ABSTRACT

An electrical switching device is disclosed, which is particularly well adapted for use in a hold-up alarm system. The device comprises a casing having a longitudinal axis and two lateral openings symmetrically positioned with respect to the longitudinal axis and a push-button switch centrally mounted inside the casing, and having an actuating push-button coaxial to the casing. The push-button switch is connected in series with an electrical circuit so that this circuit is switched on or off when the button is pressed. The device also comprises a flexible blade extending transversally inside the casing, the blade having a central portion adjacent to the push button and two opposite ends; and manually operable device for squeezing the blade in such a manner as to cause it to bend and press onto the push button to activate the switch. The squeezing device includes a pair of actuating arms symmetrically mounted inside the casing, each of the arms extending across one of the lateral openings and having at least one portion that is movable inwards the casing to press against one of the ends of the blade whenever a pressure is exerted through one of the openings. The blade and arms are so dimensioned and positioned as to cause the blade to bend sufficiently to activate the push-button switch only when both of these arms are pushed in simultaneously.

8 Claims, 2 Drawing Sheets

ELECTRICAL SWITCHING DEVICE

BACKGROUND OF THE INVENTION (a) Field of the Invention

This invention relates to a new electrical switching device especially but not exclusively designed for use in a hold-up alarm system. More particularly, the invention relates to a new electrical switching device comprising a pair of manually operable arms which, when they are pushed simultaneously in, cause a thin flexible blade to bend and press onto a push-button switch located in a casing, thus causing an electrical circuit to be closed or opened and to actuate a remote system, such as an alarm system.

(b) Brief Description of the Prior Art

During any robbery that is in the form of a sudden and quick attack, it is known that the thief and the personnel of the institution being robbed are all subjected to a tremendous amount of nervous tension. Since almost all robberies of this type are made with firearms as intimidating means, it is important that the employees cooperate to protect their lives, without seemingly interfering with the robber's plans. It is however also important that an alarm be given, without attracting the robber's attention. The necessity of having access to an alarm system so constructed and arranged as to avoid arising suspicion in the robber's mind and causing a panic reaction which could eventually become threatening to the personnel's security is well known and evident for everyone.

Several robbery alarm systems have already been constructed to quickly yet quietly close an alarm circuit and thus warn police officials that a robbery is taking place in the building where the alarm system is located.

Alarm systems of this type have been constructed, including a switch actuated by the downward movement of a press-button placed on a floor. The use of such systems is questionable since it is often subjected to be operated unintentionally.

Another type of alarm system has been proposed, including a switch to be actuated by the upward movement of the foot of a cashier or teller. With such systems, inadvertent pressure exerted onto the switch by a foot does not close the circuit and sound the alarm. Such alarm systems are described in U.S. Pat. Nos. 1,496,864 and 2,054,792.

U.S. Pat. No. 4,300,129 discloses another alarm system, including a pull-type switch which normally rests on a trigger pin. When the switch is depressed by the action of a finger, the trigger pin is released and an alarm circuit is closed, thus activating the alarm circuit.

More sophisticated systems have been proposed, comprising a pair of push buttons which selectively sound different call means, when operated singly, or sound an alarm when operated simultaneously. For example, U.S. Pat. No. 4,737,751 describes an alarm system having two independently engageable plungers that must be simultaneously pressed by a cashier or by any other person to activate the alarm circuit.

The main problem associated with the one-button alarm systems is that, in spite of their reliability, they are subject to accidental activation by a cashier during routine, non-emergency situations.

The main problem associated with the two-button alarm systems is that they are rather complicated in structure and thus expensive.

OBJECTS OF THE INVENTION

An object of the invention is to provide an electrical switching device which is particularly yet not exclusively well adapted to be used in a hold-up alarm system, which comprises a pair of manually operable arms that must be operated simultaneously to sound a distant alarm system and is much simpler in structure than any known switching device of the same type.

Another object of the invention is to provide an electrical switching device forming part of a hold-up alarm system, which can be placed under a desk in order to be secretly activated by a person being robbed.

A further object of the invention is to provide a device of the above-mentioned type that is not likely to be inadvertently actuated by a busy person to provoke a false alarm.

SUMMARY OF THE INVENTION

In accordance with the invention, these objects are achieved with a new electrical switching device particularly well adapted for use in a hold-up alarm system, comprising a casing having a longitudinal axis and two lateral openings symmetrically positioned with respect to the longitudinal axis; a push button switch centrally mounted inside the casing, and having an actuating push-button coaxial to the casing; means for connecting the push-button switch in series with an electrical circuit so that this circuit is switched on or off when the button is pressed; a flexible blade extending transversally inside the casing, the blade having a central portion adjacent to the push button and two opposite ends; and manually operable means for squeezing the blade in such a manner as to cause it to bend and press onto the push button to activate the switch. The squeezing means includes a pair of actuating arms symmetrically mounted inside the casing, each of the arms extending across one of the lateral openings and having at least one portion that is movable inwards the casing to press against one of the ends of the blade whenever a pressure is exerted through one of the openings. The blade and arms are so dimensioned and positioned as to cause the blade to bend sufficiently to activate the push button switch, only when said both arms are pushed in simultaneously. The blade and arms are also dimensioned and positioned so as to give a tactile yet inaudibly "feedback" signal to the user that the push button is activated.

Other objects and important features of the invention will become more apparent from the following description given in connection with the accompanying drawings which disclose a preferred embodiment of the invention. It is to be understood that the drawings are purely illustrative and are not intended to limit in any way the invention as broadly claimed hereinafter.

BRIEF DESCRIPTION OF THE DRAWINGS

In the drawings, wherein similar reference numbers denote similar elements throughout the different views.

DESCRIPTION OF A PREFERRED EMBODIMENT

Figure 1:
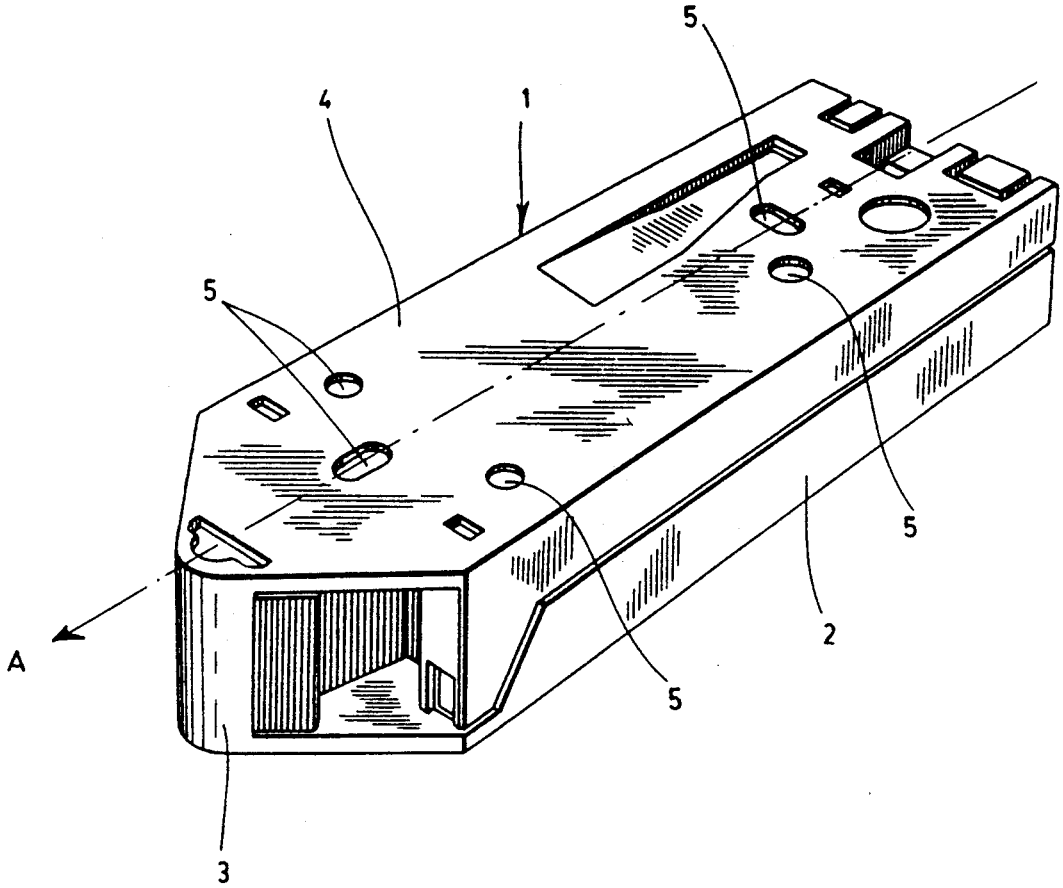
FIG. 1 is a top perspective view showing the casing of an electrical switching device according to the invention.

The electrical switching device shown in the accompanying drawings includes a casing 1 having a longitudinal axis "A" and comprising a main body 2 in the shape of a rectangular box and a triangular tip 3 comprising a solid end 14, a pair of symmetrical openings 15, 15', and an open chamber 16 comprising a centrally positioned switch 21 having an actuating push-button 20. The chamber 16 also comprises a manually operable means to press on the push-button 20 and thus activate the switch 21 to allow a distant alarm system to sound and warn police officials that a crime is being committed in the building where the alarm switch is located. The elements of the actuating means will be described hereinafter in detail.

The openings 15, 15' are big enough to allow insertion of the user's thumb and forefinger through each of the two lateral openings, thus allowing direct access to he elements inside the chamber 16. The casing 1 has a removable top panel, fitted to cover tightly the main body 2 and the triangular tip 3. The casing 1 also has a base portion 4 provided with holes 5 for use to fasten the device by its base 4, with nails or screws under a desk top. The rectangular body of the casing 1 further encloses a electronic printed circuit 6 which is operatively connected to the switch 21 and is provided with outlets 7 to supply the printed circuit 6 with power and to connect the latter to the remote alarm system. The details of the printed circuit 6 are not shown in the accompanying figures.

The main feature of the manually operated means is a pair of actuating arms 8, 8', preferably made of plastic, cooperating with a flexible blade 13 attached thereto, whose function will be discussed in greater detail hereinafter. Each actuating arm is made of a single piece of plastic material divided into two different segments. Since there are two symmetrical arms, the same number with a prime will be given to the "other" symmetrical elements. The first segment forms a base portion 9, 9', solidly fixed inside a small channel 12, 12' located at the interface between a transverse side of casing 1 and the base of triangular tip 3. Base portion 9, 9' is extended by a movable portion 10, 10', forming the second segment of actuating arms 8, 8'. The portion 10, 10' is directly hinged on the base portion 9, 9' and diagonally extending away from the same towards the narrower part of triangular section 3. In the middle section of open chamber 16, movable portion 10, 10' extends into a bulge 11, 11', projecting towards an opening 15, 15'. The lower segment of the bulge is parallel to the opening and is freely supported on the internal wall 23 of solid section 14. A stopper 17, 17' attached to the lower part of bulge 11, 11' is sized to engage a groove 18, 18' furrowed in the internal part of solid section 14 and thus prevents the arms 8, 8' to extend outside of this groove.

A thin flexible blade 13 connects both upper parts of symmetrical movable portions 10, 10'. The blade 13 is located in the imaginary axis defined by both aforementioned channels 12, 12'. In deactivated position, the internal tension of flexible blade 13 causes both movable portions 10, 10' to rest in their outermost position, with stoppers 17, 17' wedged in grooves 18, 18'. Each edge of the blade 13, is securely inserted in a groove formed by a pair of parallel ridges 19, 19', provided on the movable portions 10, 10' to rigidly maintain the edges of metal blade 13 thereto. The middle part of metal blade 13 is a few millimeters away from the push-button 20 forming part of the actuating switch 21.

Figure 2:
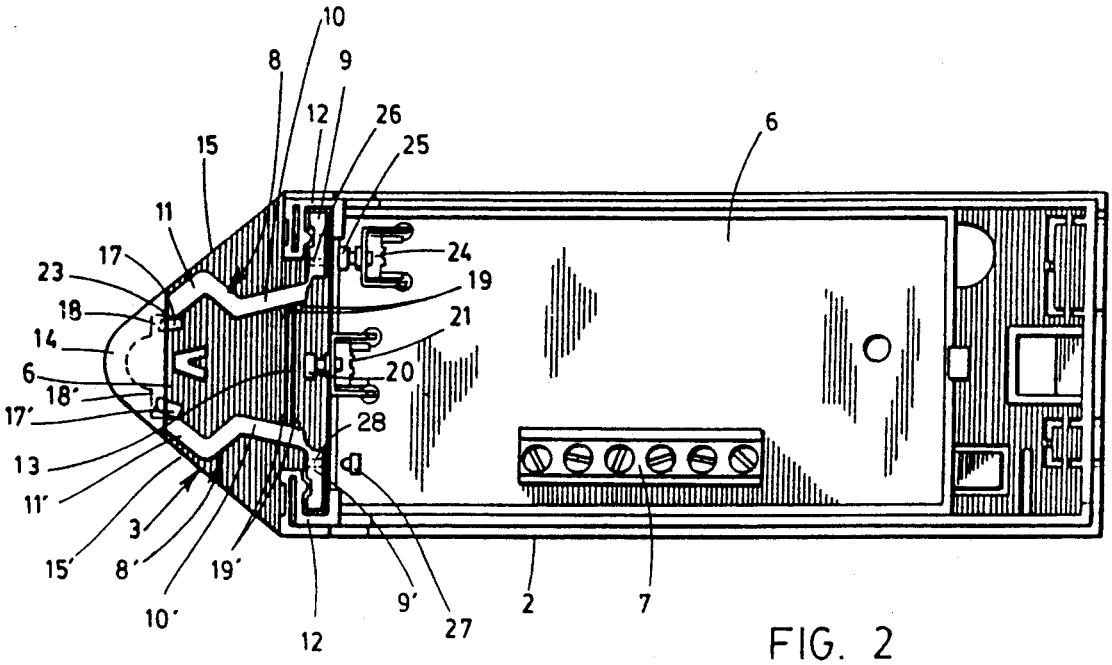
FIG. 2 is a top plan view of the bottom portion of the switching device shown in FIG. 1 in deactivated position.
Figure 3:
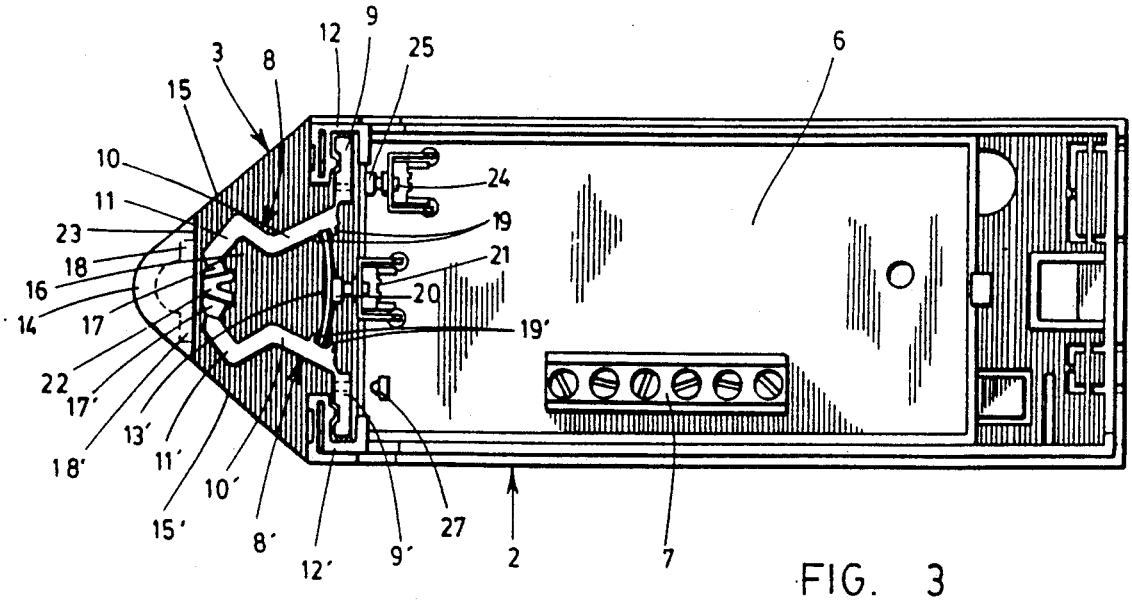
FIG. 3 is a top plan view similar to that of FIG. 2, showing the system in activated position.

FIG. 2 shows the electrical switching device containing all of the aforedescribed elements in their rest position. FIG. 3 shows the same elements in activated position. When a user inserts the thumb and forefinger inside the open chamber 16 and pushes onto both actuating arms 8, 8' simultaneously, by pressing on bulges 11, 11', the flexible blade 13 is bent towards the push-button 20 and pushes it fully inside the switch 21, thereby activating the printed circuit 6 and activating the remote summoning alarm. A "V"-shaped plastic piece 22 is rigidly secured onto the base 4 of open chamber 16, to prevent exaggerated inward movement of arms 8, 8'.

A reset switch 24, also equipped with a press button 25, can be mounted within said casing and operatively connected to the printed circuit 6. This switch can be operated by insertion of a needle in a hole 26 provided for this purpose in one of the arms 8. A LED 27 can also be mounted on the printed circuit 6 to provide a visual indication through a hole 28 provided for this purpose in the other arm 8'.

What is claimed is:

1. An electrical switching device particularly well adapted for use in a hold-up alarm system, comprising:

a casing having a longitudinal axis and two lateral openings symmetrically positioned with respect to said axis;

a push button switch centrally mounted inside said casing, said switch having an actuating push-button coaxial to said casing;

means for connecting said push-button switch in series with a remote electrical circuit so that said circuit is switched on or off when the button of said switch is pressed;

a flexible blade supported inside said casing, said flexible blade extending transversely inside said casing, said blade having a central portion adjacent to the push button of said switch and two opposite ends; and manually operable means for squeezing the blade in such a manner as to cause it to bend and press onto the push button to activate the switch, said squeezing means including a pair of actuating arms symmetrically mounted inside the casing, each of said arms extending across one of said lateral openings and having at least one portion that is movable inwards the casing to press against one of said ends of said blade whenever a pressure is exerted thereon through one of said lateral openings, wherein said push-button switch is actuated only when both of said arms are pushed in simultaneously.

2. An electrical switching device of claim 1, wherein each said actuating arm comprises:

a base portion extending transversely with respect to the casing and rigidly secured inside a small channel coaxial with said base portion;

a movable portion hinged on said base portion, on which said end of said blade is fixed and on which pressure can be manually exerted.

3. An electrical switching device of claim 2, wherein said movable portion of each of said actuating arms extends diagonally inwards from said base portion.

4. An electrical switching device of claim 3, wherein each said end of said blade is securely inserted in a groove formed by a pair of parallel ridges placed on said movable portions of said actuating arms.

5. An electrical switching device of claim 4, wherein said flexible blade extends linearly from one said movable portion of said actuating arm to the other.

6. An electrical switching device of claim 4, wherein said flexible blade is placed on said movable portion of said actuating arm, close to said base portion and at a close distance from said actuating push-button.

7. An electrical switching device of claim 1, further comprising a reset switch mounted within said casing, and means for connecting said reset switch to said circuit.

8. An electrical switching device of claim 1, wherein said casing has a removable top panel; further comprising means for securing said top panel to a planar surface.

* * * * *